US007882866B2

(12) United States Patent
Burrows

(10) Patent No.: US 7,882,866 B2
(45) Date of Patent: Feb. 8, 2011

(54) INVERTED MULTIPLE ROUTER STATION

(75) Inventor: Lloyd Pulsifer Burrows, Truro (CA)

(73) Assignee: Woodmaster Tools, Inc., Kansas City, MO (US)

( * ) Notice: Subject to any disclaimer, the term of this patent is extended or adjusted under 35 U.S.C. 154(b) by 294 days.

(21) Appl. No.: 11/873,242

(22) Filed: Oct. 16, 2007

(65) Prior Publication Data

US 2008/0115855 A1 May 22, 2008

Related U.S. Application Data

(60) Provisional application No. 60/852,287, filed on Oct. 17, 2006.

(51) Int. Cl.
*B25H 1/14* (2006.01)

(52) U.S. Cl. ..... 144/135.2; 144/136.1; 144/286.5; 144/287

(58) Field of Classification Search ..... 144/135.2, 144/135.3, 135.4, 136.1, 286.1, 286.5, 287, 144/1.1, 2.1, 3.1; 269/289 R
See application file for complete search history.

(56) References Cited

U.S. PATENT DOCUMENTS

| | | | | |
|---|---|---|---|---|
| 10,844 A | | 5/1854 | Norcross | |
| 27,986 A | | 4/1860 | Jones | |
| 396,399 A | | 1/1889 | Grzybowski | |
| 1,090,236 A | | 3/1914 | Ross | |
| 1,264,165 A | | 4/1918 | Eaglesfield | |
| 1,407,112 A | | 2/1922 | Young | |
| 1,456,864 A | | 5/1923 | Blood et al. | |
| 2,571,861 A | | 10/1951 | Gegumis | |
| 4,660,609 A | | 4/1987 | Miller | |
| 4,763,706 A | * | 8/1988 | Rice et al. | 144/136.1 |
| 5,025,841 A | | 6/1991 | Totten | |
| 5,809,631 A | * | 9/1998 | Poulin | 29/560 |
| 6,857,456 B2 | * | 2/2005 | Manning | 144/286.5 |
| 7,111,655 B1 | * | 9/2006 | Hall | 144/286.5 |
| 2006/0144470 A1 | | 7/2006 | Fontaine | |

FOREIGN PATENT DOCUMENTS

| | | |
|---|---|---|
| CN | 1082971 A | 3/1994 |
| GB | 03964 A | 2/1910 |
| GB | 750732 A | 6/1956 |

OTHER PUBLICATIONS

International Search Report and Written Opinion issued in related PCT Patent Application Serial No. PCT/US07/081535, dated Jan. 30, 2008, 14 pages.

* cited by examiner

*Primary Examiner*—Shelley Self
(74) *Attorney, Agent, or Firm*—Lathrop & Gage LLP

(57) ABSTRACT

There is disclosed an apparatus that works a work piece that employs routers disposed on opposite upper and lower sides of a table. The routers operate on opposite sides of a work piece contemporaneously. The resultant work piece may be worked so as to be uniform and identical with previously and successively worked work pieces.

7 Claims, 11 Drawing Sheets

INVERTED MULTIPLE ROUTER STATION

CROSS REFERENCES TO RELATED APPLICATIONS

This patent application claims priority from and is related to commonly owned U.S. Provisional Patent Application Ser. No. 60/852,287, entitled: Inverted Multiple Router Station, filed on Oct. 17, 2006, the disclosure of which is incorporated by reference herein.

TECHNICAL FIELD

The disclosed subject matter relates to apparatus and methods for working on a work piece such as a wood board, and in particular, to working three sides of the board to produce a finished piece.

BACKGROUND

Woodworking requires multiple skills, and in particular, working on a board is typically time consuming, as three sides of the board are typically worked. The work must be detailed, so as to properly dimension each piece, so the pieces will fit together in a proper alignment. Completion of a work piece with the necessary tolerances, typically involves hand working the two oppositely disposed smaller sides with routers, while a third side or face must also be hand worked, with either a router, planer or the like, in separate operations.

SUMMARY

The disclosed subject matter provides an apparatus and method that automatically works up to three sides of a board contemporaneously, with precision, such that the finished boards have tight tolerances and can be aligned.

The disclosed subject matter includes an apparatus that works a work piece that employs routers disposed on opposite upper and lower sides of a table. The routers operate on opposite sides of a work piece contemporaneously. The resultant work piece may be worked so as to be uniform and identical with previously and successively worked work pieces.

The disclosed subject matter is directed to a material working apparatus, for working on a work piece, such as a board or the like. The apparatus has at least two holders for routers, that are mounted on each holder, for example, a router is held by a first holder, and a router is held by a second holder. There is a first table including a substantially planar bed, the substantially planar bed intermediate the first holder and the second holder, the first table for supporting a work piece and the bed including an open area therein, the open area defining a work area for the routers held by the first holder and the second holder. The bed is movable between the first holder and the second holder, with the first holder and the second holder positioned with respect to the bed, such that portions of the routers, held by the first holder and the second holder, are operative within the work area.

The table, i.e., the bed, is moved vertically by a lifting system, activated by the user. There is also a second or planer table for aligning with the first table to form a pathway for the work piece. The second table includes a planer for working an additional side of the work piece.

Another embodiment is directed to a material working apparatus. The apparatus includes a platform, for example, a bed, for supporting a work piece to be moved along the platform. The platform has a first end and a second end. There is at least one first router, for example, one router, movably connected to the platform, positioned above the platform, the at least one first router including a portion for operating on a work piece. There is at least one second router, for example, one router, movably connected to the platform, positioned below the platform, the at least one second router including a portion for operating on a work piece. The operating portions, for example, blades, of the at least one first router and the at least one second portion are designed for operating on a work piece moving along the platform, at least contemporaneous in time.

Another embodiment is directed to a method for working a work piece, such as a wood board or the like. The method includes providing a material working apparatus including a platform, for example, a bed, for supporting a work piece to be moved along the platform, the platform including a first end and a second end. Also provided is at least one first router movably connected to the platform, positioned above the platform, the at least one first router including a portion for operating on a work piece, and at least one second router movably connected to the platform, positioned below the platform, the at least one second router including a portion for operating on a work piece. A work piece is moved along the platform. The work piece is worked by the operating portions, for example, blades, of the at least one first router and the at least one second router, for example, contemporaneously.

BRIEF DESCRIPTION OF THE DRAWINGS

Attention is now directed to the drawings, where like reference numerals or characters indicate corresponding or like components. In the drawings.

DETAILED DESCRIPTION OF THE DRAWINGS

In this document, references are made to directions, such as upper, lower, top, bottom, up, down, upward, downward, clockwise, counterclockwise, etc. These directional references are exemplary, to show the disclosed subject matter in a typical orientation, and are in no way limiting.

Figure 1:
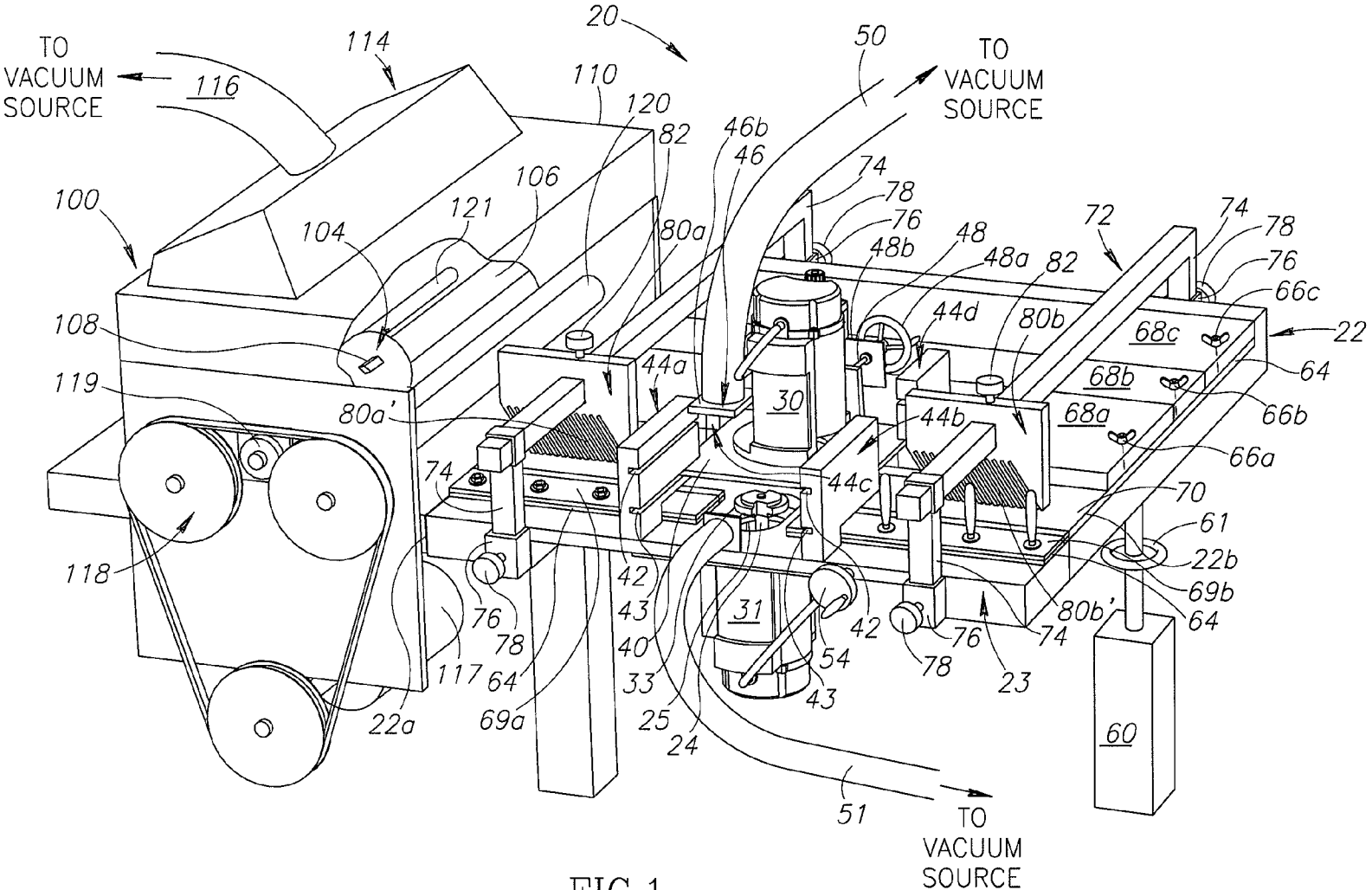
FIG. 1 is a perspective view of an apparatus that provides for working a work piece.
Figure 2A:
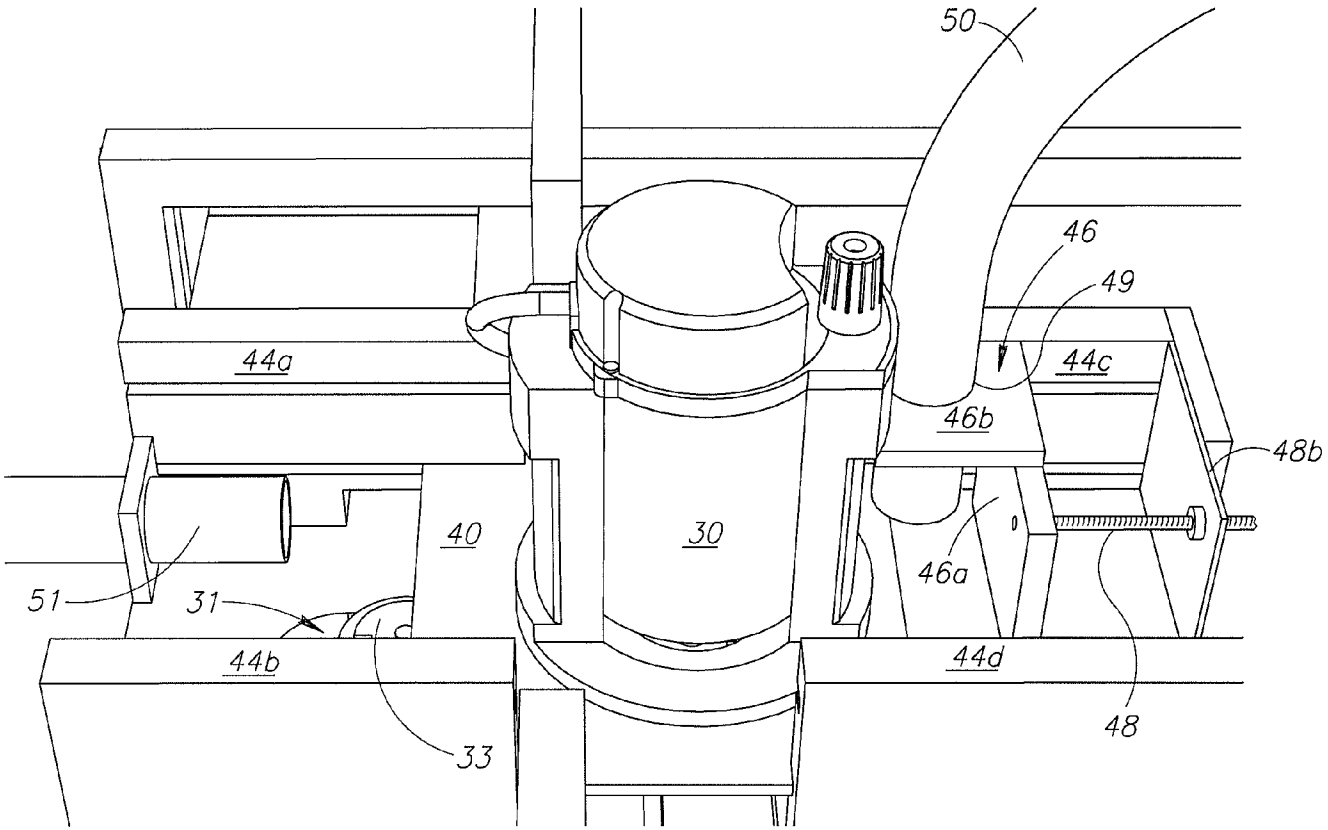
FIG. 2A is a top perspective view of the upper router of the apparatus of FIG. 1 and its movement system.
Figure 2B:
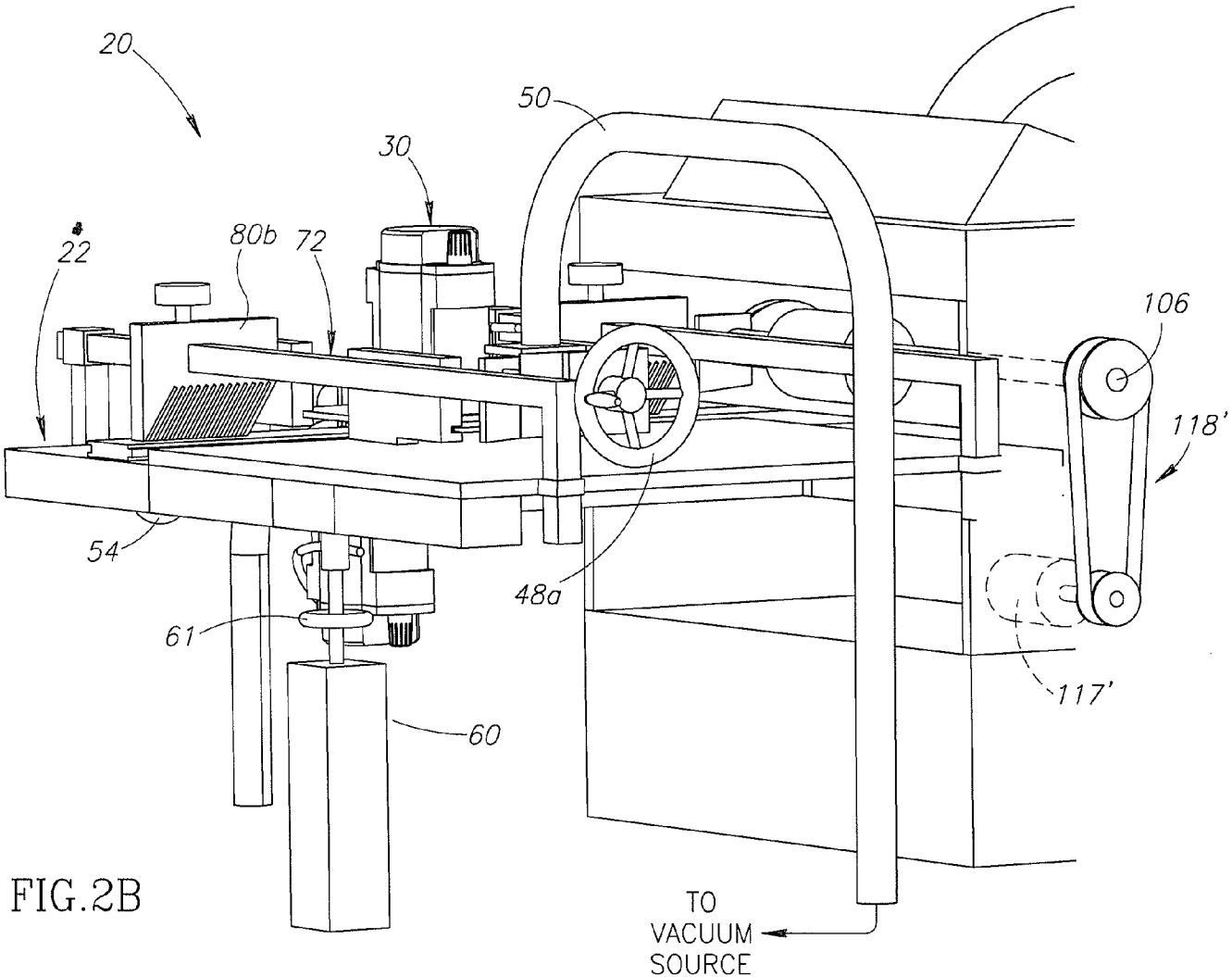
FIG. 2B is a side perspective view of the table of the apparatus.
Figure 3:
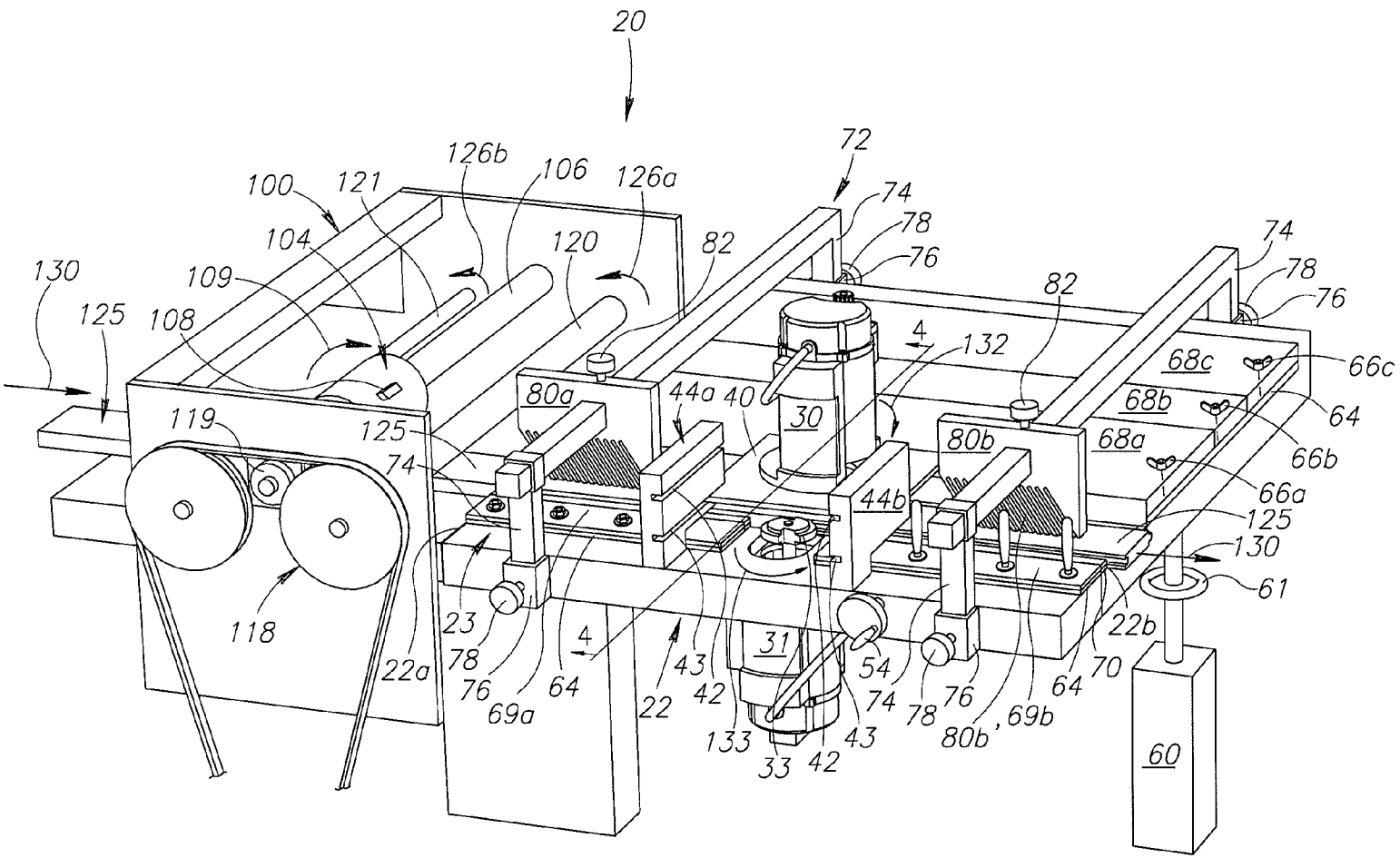
FIG. 3 is a perspective view of the apparatus of FIG. 1, with some of the components shown in FIG. 1 removed, and a work piece being worked in the apparatus.
Figure 4:
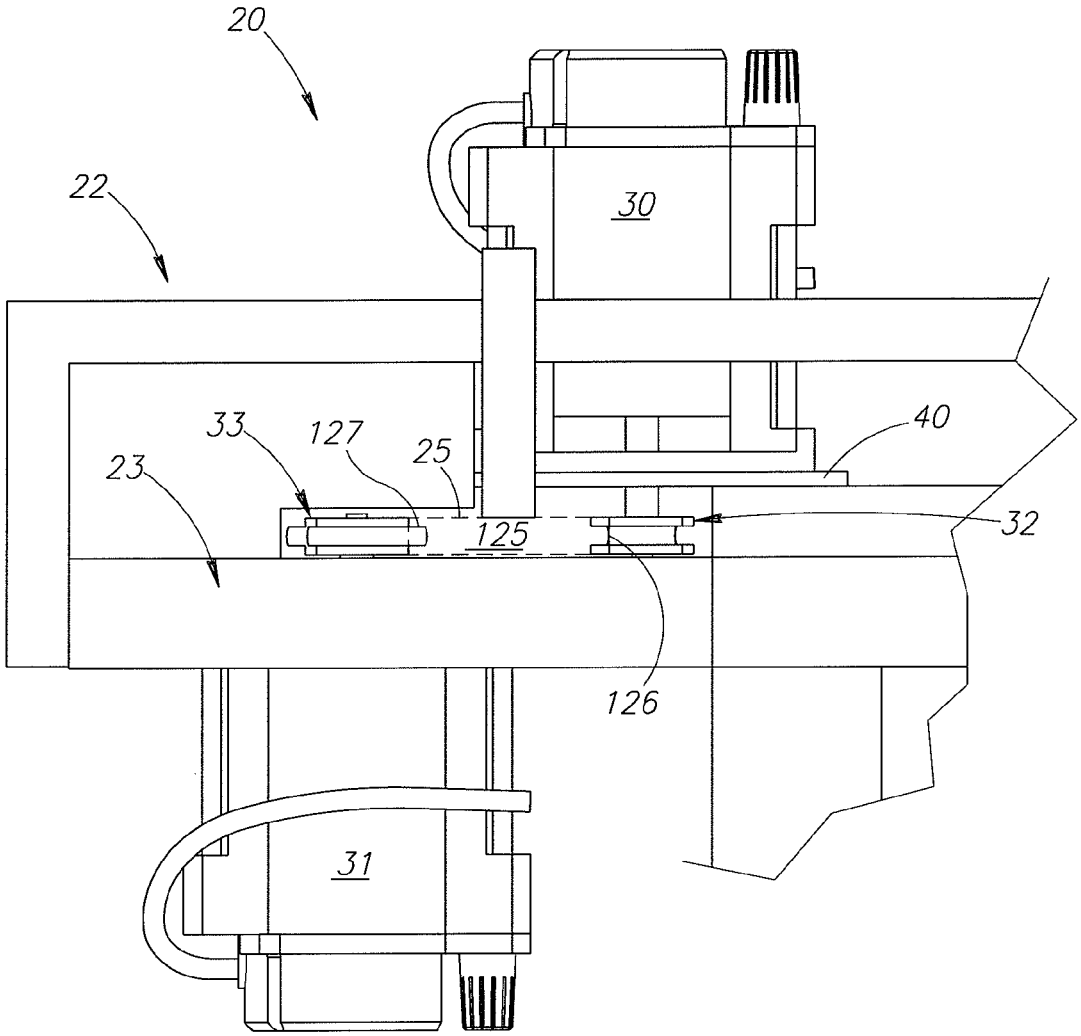
FIG. 4 is a cross-sectional view of the work piece of FIG. 3 being worked, taken along line 4-4 of FIG. 3.

FIGS. 1, 2A and 2B show an apparatus 20. The apparatus 20 includes a table 22, having a bed 23, with an opening 24 therein, defining a work area 25 for a work piece that is pushed therethrough (FIGS. 3 and 4). The table 22 supports instrumentation, for example, routers 30, 31, disposed on opposite sides of the bed 23 of the table 22. For example, the router 30 is above the table 22 (bed 23), and is referred to hereinafter as the upper router 30. The other router 31 is disposed below the table 22 (bed 23), and is referred to hereinafter as the lower router 31. For purposes of explanation, the table 22 includes an ingress end 22*a*, where a work piece is received, and an egress end 22*b*, from where a work piece is discharged.

The routers 30, 31 are positionable, such that their operative tips or blades 32, 33 (FIG. 4), are positionable within the work area 25. Additionally, the operative tips or blades 32, 33 (FIG. 4), are designed to rotate in rotational directions to move in a direction away from the egress end 22*b* of the table 22.

The routers 30, 31 are typically moveable laterally with respect to each other, to work oppositely disposed sides of a work piece contemporaneously, and typically simultaneously. The upper router 30 is typically mounted on a plate 40, that fits within grooves 42, 43 of oppositely disposed shelf members 44*a*, 44*b*, 44*c* (FIG. 2A), 44*d* to adjust the elevation or height of the router 30 (vertically, upward or downward with respect to the bed 23 of the table 22). The lower router 31 is typically at a fixed position, and for example, is typically mounted to the lower or underside of the table 22 (at the bed 23). The routers 30, 31 are, for example, "plunge" routers that are internally adjustable vertically.

As shown in FIG. 2A, to which attention is also directed, the plate 40 attaches to a brace 46, that joins to a screw mechanism 48, to move the router 30 laterally along the table 22. The brace 46 includes a first member 46*a*, that attaches to the plate 40 and the screw mechanism 48, moved by turning a wheel 48*a* (FIG. 2B). The screw mechanism 48 is also supported by a panel 48*b* connected to a shelf member, such as member 44*c*.

The brace 46 also includes a second member 46*b*, that attaches to the first member 46*a* and the upper router 30. The second member 46*b* typically includes an opening 49 to receive a dust collection tube 50 (typically connected to a vacuum source (not shown)) and extending proximate to the work area 25, for collecting dust from the work piece, as it is being cut. There is typically also a second dust collection tube 51, that is at the other side of the work area 25 on top of the table 22 and the bed 23, that is also connected to the vacuum source (not shown). There is also a wheel 54, that controls a screw mechanism (not shown) for additionally moving the router 30 laterally (widthwise with respect to the table 22, or in other words, perpendicular to the direction of travel for the work piece), to control the depth of the cut (made by, for example, the blade 32) into the work piece.

The table 22 is mounted on a height adjustment mechanism 60, typically a screw mechanism moved by turning a wheel 61, that also contacts the ground, as shown in FIG. 2B. This height adjustment mechanism 60, when the wheel 61 is turned, adjusts the height of the bed 23 of the table 22. The table 22 also includes an underlying sheet (or board) 64 (for example, of TEFLON® or other polymeric material, to decrease friction with a work piece) with mounts 66*a*-66*c* for supporting boards 68*a*-68*c* (for example, of TEFLON® or other polymeric material, to decrease friction with a work piece) that are clamped to the underlying sheet 64. Combined with straight pieces 69*a*, 69*b*, disposed opposite the boards 68*a*-68*c*, there is formed a path 70 for the work piece.

A frame 72 around the table 22 includes legs 74 held in receivers 76, whose position is held by adjustable clamps 78. This clamping sets the height of the frame 72, and accordingly, the height of the feather boards 80*a*, 80*b*, attached at opposite ends of the frame 72.

The feather boards 80*a*, 80*b* are movable laterally on the frame 72, and held in position by clamps 82. The feather boards 80*a*, 80*b* serve to friction restrict the work piece in the path 70, by preventing it from being ejected out the egress end of the table 22*b*. The feather boards 80*a*, 80*b* are typically angled at their lower portions 80*a*', 80*b*' to be in the direction of travel of the work piece (indicated by arrows 130 in FIG. 3).

In alternate embodiments of the apparatus 20, there may be a single router, positioned to operate on any side of the work piece, two or more routers positioned to operate on the same side of a work piece, or three or more routers, for operating on a single side, or both sides, of the work piece in any combination. Similarly, all of the routers, in any of the aforementioned arrangements, may be mounted on the upper or lower side of the table 22 if desired. In cases where multiple routers are used, the opening 24 in the table 22, and accordingly the size of the work area 25 would be adjusted to accommodate the multiple routers at their various positions.

A second or planer table 100 is typically joined to the table 22. The second or planar table 100, for example, includes an upper surface formed of a TEFLON® or other polymeric material board, so as to reduce friction on a work piece being moved over the table 100 as detailed below. These tables 22, 100 are typically joined at the end of the straight piece 69*a*.

The second table 100 includes a planer 104 mounted (and positionable on) on a cylinder 106, to rotate it. The planer 104 includes a bit 108 or the like, to create the desired effect, imprint, or the like, on the surface or side of the work piece. The planer 104 is designed to rotate in a direction against the direction of the movement of the work piece, for example, clockwise (as viewed in the direction into the paper, as per the arrow 109). When the planar 104 is in operation with the routers 30, 31, the work piece is worked on three sides contemporaneously, and typically simultaneously.

The second table 100 typically includes a cover 110, over the planer 104. The cover 110 includes a hood 114, with a dust collection tube 116. The dust collection tube 116 is also attached to the vacuum source (not shown). The cylinder 106 of the planer 104 is driven by a motor 117' and drive mechanism 118' (FIG. 2B). A motor 117 and drive mechanism 118 drive the feed rollers 120, 121, that move the work piece in a direction toward the egress end 22*b* of the table 22 (in the direction of the arrows 130 of FIG. 3).

For example, as shown in FIGS. 3 and 4, and also making reference to FIGS. 1, 2A and 2B, a work piece, for example, a wood board 125 has been placed into the apparatus 20. Previously, the height of the bed 23 of the table 22 was adjusted with respect to the routers 30, 31 (by moving the height adjustment mechanism 60, if necessary), and the feather boards 80*a*, 80*b*, have been adjusted, both vertically (by moving the frame 72), and laterally (along the frame 72), so as to be aligned. The height of the upper router 30 has also been adjusted, by moving the plate 40 in the respective shelf members 44*a*-44*d*, if necessary.

The board 125 is placed on the second table 100, under the feed rollers 120, 121, that are now rotating counterclockwise (as per the arrows 126*a*, 126*b*), to contact and move the work piece 125 toward the egress end 22*b* of the table 22 (now, the first table 22), with the work piece 125 in alignment with the path 70 of the table 22, formed by the straight pieces 69*a*, 69*b* and the board 68*a*, that serve as guides for the work piece 125. The work piece 125 is moved in the direction of the arrows 130.

The routers 30, 31 typically have blades 32, 33 that are coordinated to perform a function. For example, one blade 32 on the first router 30 may cut a tongue 126, on one side of the work piece 125, while the other blade 33 on the second router 31 cuts a correspondingly positioned groove 127 on the other side of the work piece 125. The routers 30, 31 are typically configured such that their respective blades 32, 33 move in a direction opposite the direction of travel of the work piece 125. This is typically achieved as the blade 32 on the upper router 30 rotates clockwise (as per the arrow 132), while the blade 33 on the lower router 31 rotates counterclockwise (as per the arrow 133). Similarly, the planer 104 rotates on its roller 106 in a clockwise direction, as per the arrow 109.

The work piece 125 is pushed by the feed rollers 120, 121 along the second table 100 and the first table 22 in the pathway. Once beyond the feed rollers 120, 121, the work piece 125 may be moved manually, so that a finished work piece 125 is discharged from the egress end 22*b* of the first table 22.

Figure 5:
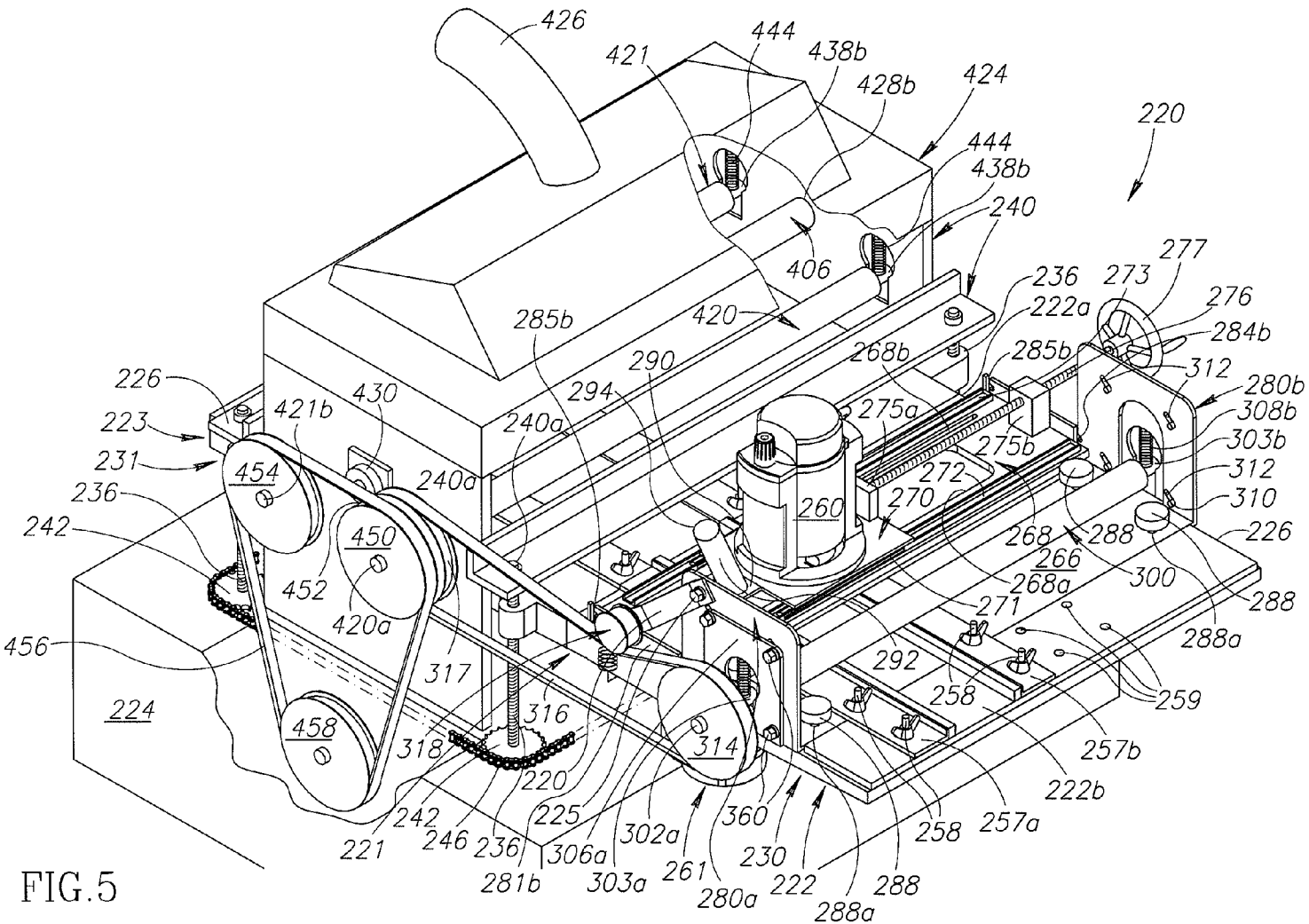
FIG. 5 is a front perspective view of an apparatus of another embodiment of the disclosed subject matter.
Figure 6:
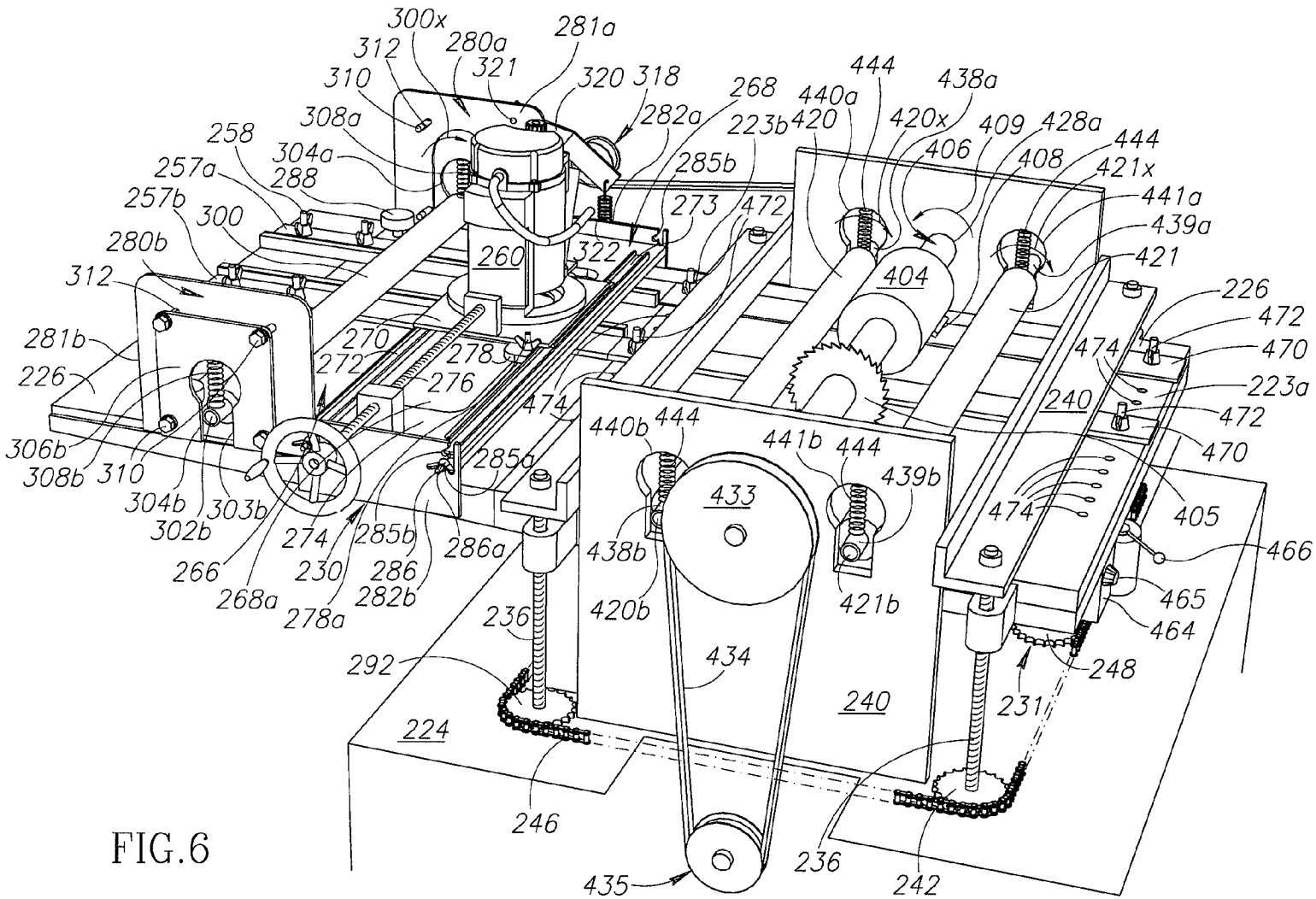
FIG. 6 is a rear perspective view of the apparatus of FIG. 5.

FIGS. 5 and 6 show another apparatus 220 in accordance with the disclosed subject matter. The apparatus 220 includes many components identical or similar to those described for the apparatus 20 above.

FIG. 5 shows the apparatus 220, that is formed, for example, of a bed or platform 221 with two portions 222, 223. The bed 221 is supported on a frame 224. The bed 221, with its portions 222, 223, support one or more boards 226 over which a work piece is moved during processing, as detailed below. When multiple boards 226 are used, the boards 226 are in close proximity to each other, and usually in abutment. The boards 226 attach to the bed portions 222, 223 by screws 228 (in corresponding openings in the bed portions 222, 223), to define tables 230, 231. The boards are made of, for example, a plastic or polymeric material, such as TEFLON® so as to minimize friction on a work piece passing over the tables 230, 231.

The bed 221 and its portions 222, 223 are moved vertically, as receivers 234 with threaded openings, attached to the bed 221, for example, at the portion 223, receive correspondingly threaded rods 236. The threaded rods 236 are supported by the frame 224 at one end (a lower end) and by a roller support frame 240 at the other end (an upper end), that receives the threaded rods 236 in openings (not shown in the frame 240). Each threaded rod 236 includes a sprocket 242 at the lower end. A chain 246 extends around the sprockets 242 and coupled with a sprocket 248 on a shaft 250 that extends from a two way drive motor (M) 251 (shown in FIG. 7), to drive the chain 246 in both directions (to raise and lower the bed 221).

The first bed portion 222 and its covering board 226 define a table 230. Guides 257*a*, 257*b* attach to the board 226 by screws 258. The guides 257*a*, 257*b*, include slots 259 (the slots through the board 226 under the guides 257*a*, 257*b* not shown), that accommodate the screws 258. The slots 259 are arranged in rows, allowing for lateral placement of the guides 257*a*, 257*b*, with the guides 257*a*, 257*b* locked in the desired fixed position by the screws 258. The guides 257*a*, 257*b* are, for example, L-shaped pieces of sheet metal, attached to plastic, such as TEFLON® rods, with the TEFLON® rods facing each other to provide a smooth contact surface for the finished work piece.

The bed portion 222 supports instrumentation, for example, routers 260, 261, disposed on opposite sides of the bed portion 222. The routers 260, 261, respectively, are identical or similar to routers 30 and 31, detailed above. Similar to the routers 30, 31, detailed above, for example, the router 260 is above the bed portion 222 is referred to hereinafter as the upper router 260. The other router 261 is disposed below the bed portion 222 is referred to hereinafter as the lower router 261. For purposes of explanation, the table portion includes an ingress end 222*a*, where a work piece is received, and an egress end 222*b*, from where a work piece is discharged. The routers 260, 261 are, for example "plunge" routers, in that in the routers themselves there is vertical adjustability. This allows for vertical adjustment of the blades 262, 263 by adjusting the routers 260, 261 themselves.

Figure 7:
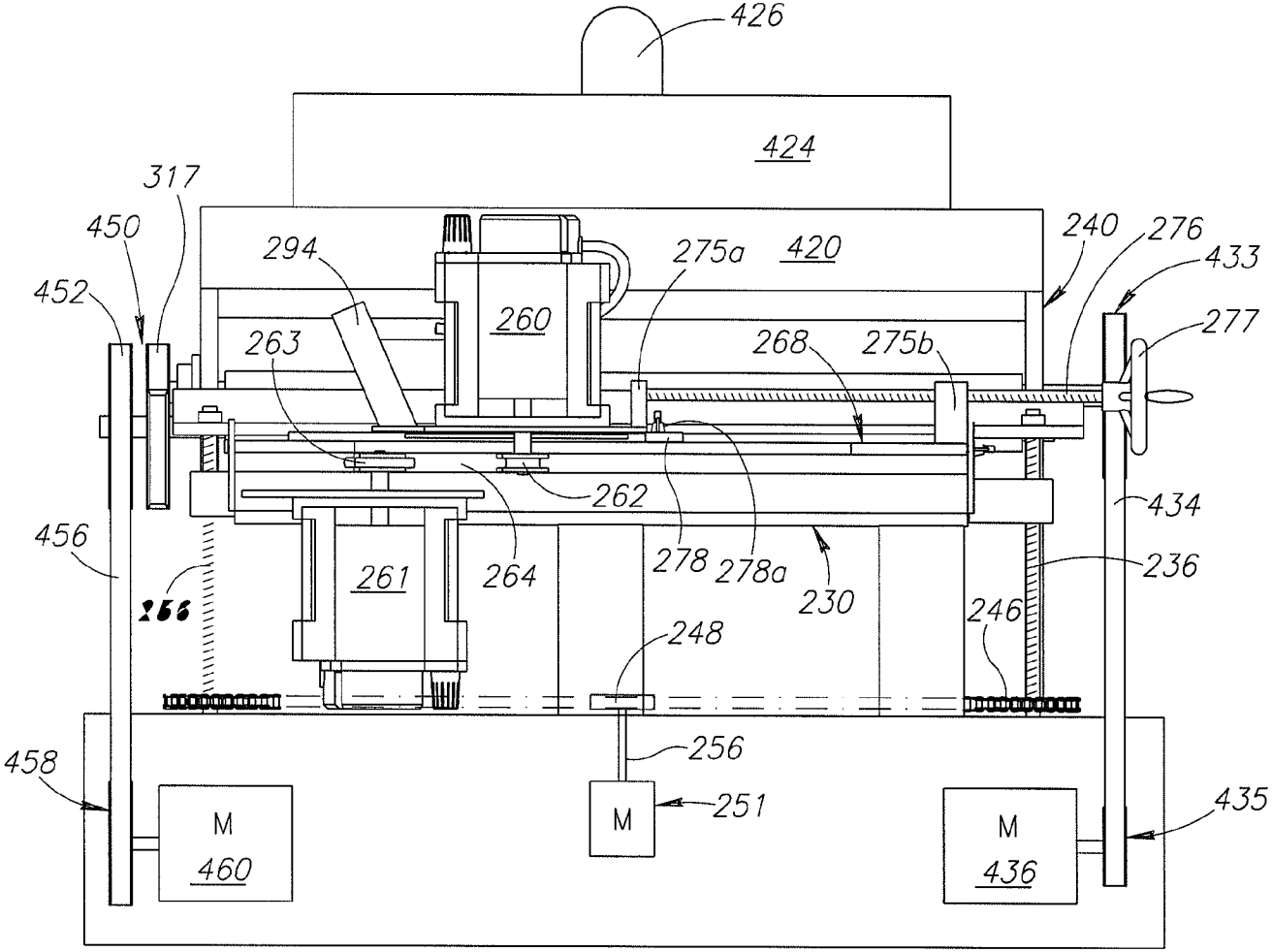
FIG. 7 is a cross-sectional view of the routers of the apparatus of FIG. 5.

Turning also to FIG. 7, the routers 260, 261 are positionable, such that their operative tips or blades 262, 263 (identical or similar to blades 32 on the upper router 30, 33 on the lower router 31, detailed above) positionable within a work area 264 (FIG. 7), the space between a shelf 268 and the board 226 of the table 230. The blades 262, 263, for example, are correspondingly configured, in that one blade 262 is designed to cut a tongue in a work piece, while the other blade 263 is designed to cut a groove in the work piece, so that work pieces will fit to each other. Additionally, the operative tips or blades 262, 263 are designed to rotate in rotational directions to move in a direction away from the egress end 222*b* of the bed portion 222 (arrows 502 and 503 of FIG. 10).

The routers 260, 261 are such that the upper router 260 is moveable laterally with respect to the lower router 261. This allows for adjustment to the width of the work piece, such that the routers 260, 261 can work oppositely disposed sides of a work piece contemporaneously, and typically simultaneously. The upper router 260 is typically mounted on a router table 266 that includes a vertically adjustable shelf 268. The router table 266 seats in an indentation in the board 226 of the table 230. The upper router 260 is mounted on a plate 270, that attaches to blocks 271 that ride in grooves 272, 273. The plate 270 and grooves 272 are positioned on the shelf 268. The grooves 272, 273 are on opposite sides of the shelf 268. A block 275*a* attaches to the plate 270. The block 275*a* fixedly receives a threaded screw member 276, that extends through a threaded block 275*b* and terminates in a circular or rounded handle 277. Rotation of the handle 277 causes the plate 270 and accordingly, the upper router 260 to move and be adjusted laterally, toward or away from the lower router 261 depending on the direction the handle 277 turned. The shelf 268 includes an opening 268*a* for accommodating the blade 262 of the router 260.

The shelf 268 also typically includes a slot 268*b*, in which a locking member 278 is supported. The locking member 278 is moved manually and locked manually by clamping action of a locking nut 278*a* on a screw 278*b*. The locking member 278 abuts the plate 270, and when clamped or locked, prevents the plate 270 from moving. This abutment keeps the plate 270 and the upper router 260 in fixed positions. Coupled with the lower router 261 in a fixed position, the work piece will not be subject to play, and accordingly, will be cut precisely.

The shelf 268 is received in slots 284*a*, 284*b*, 285*a*, 285*b* on the respective, main portions 281*a*, 281*b*of the brackets 280*a*, 280*b*, and the extended portions 282*a*, 282*b* of the brackets 280*a*, 280*b* of the router table 266. The brackets 280*a*, 280*b*, along with their main portion 281*a*, 281*b* and extended portions 282*a*, 282*b* and slots 284*a* (lower), 284*b* (upper), 285*a* (lower), 285*b* (upper) are symmetric (the slots 284*a*, 284*b*, 285*a*, 285*b* allowing for level positioning of the shelf 268). The slots 284*a*, 284*b*, 285*a*, 285*b* receive screws 286, with locking nuts 286*a*, that keep the plate 270 and the upper router 260 at a constant elevation. While the screws 256 are shown received in lower slots 284*a*, 285*a*, the screws 286 may be received in upper slots 284*b*, 285*b* allowing for vertical adjustment of the upper router 260. The router table 266 is attached to the board 226 by screw knobs 288, received in openings 288*a* in the board 226.

The plate 270 also includes an area 290 with an opening (not shown), over which is attached a suction tube holder 292.

The suction tube holder 292 receives a suction tube 294, that is connected to a vacuum or suction source (not shown), for suctioning dust and particulate from the work area, cut by the router blades 262, 263.

Figure 8:
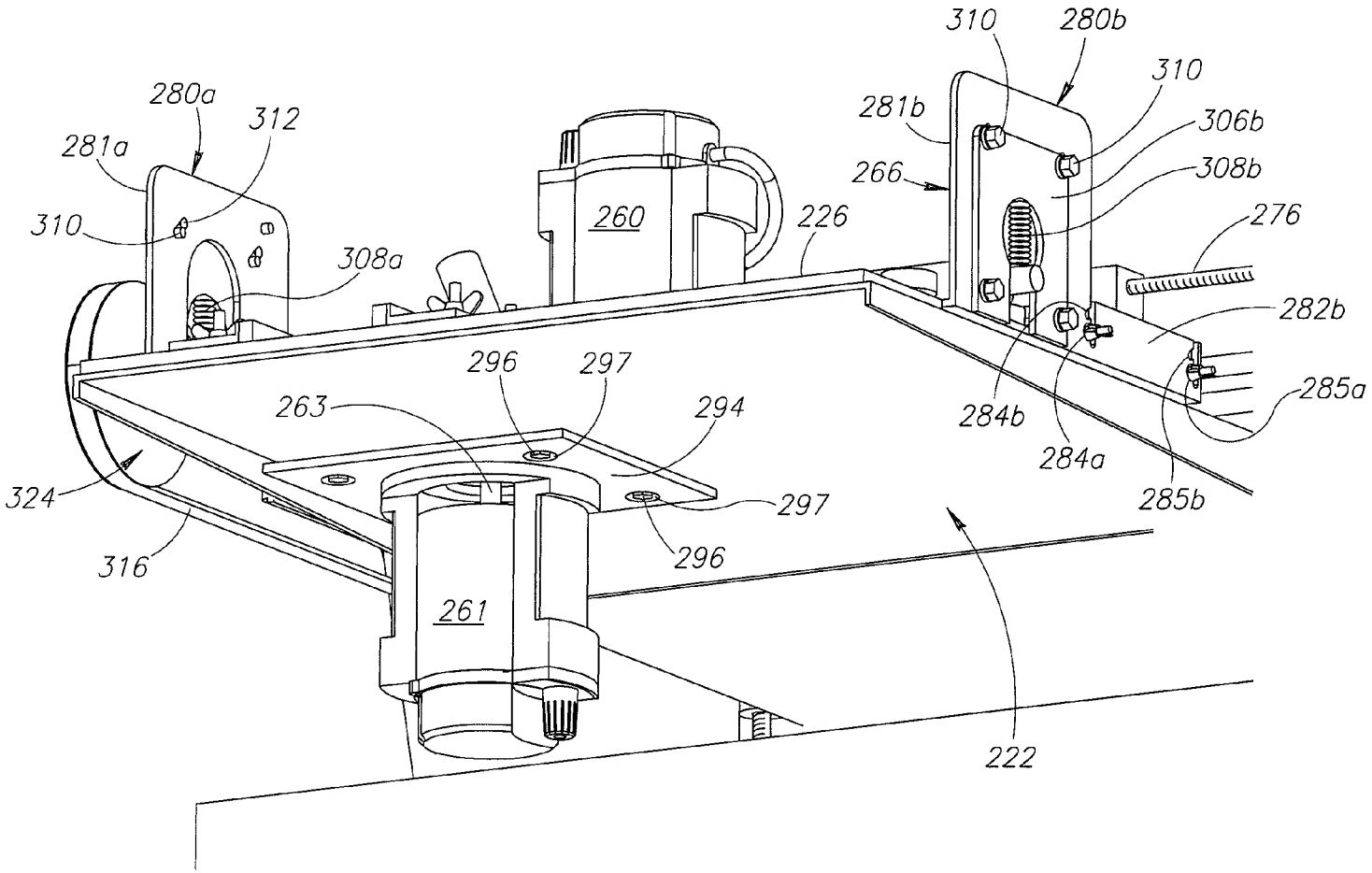
FIG. 8 is a perspective view of a portion of the apparatus of FIG. 5 detailing the lower router.

The lower router 261 is typically at a fixed position, and, for example, is typically mounted to the lower or underside of the bed portion 222 (of the table 230), as shown in FIG. 8. The lower router 261 is mounted such that its blade 263 will extend into the work area 264 (FIG. 7) so as to be coordinated with the blade 262 of the upper router 260, to perform the desired working of the work piece. The mounting includes an anchor plate 294 joined to the bed portion 222 by hex head screws 296 received in counter sunk openings 297 in the board 226 that forms the bed 230. The counter sunk openings 297 may be at multiple locations, spaced corresponding to the hex head screw positions on the board 226 of the bed 230, allowing for lateral adjustability of the lower router 261.

A feed roller 300 is positioned proximate the egress end 222*b* of the bed portion 222. The feed roller 300 includes protruding rods 302*a*, 302*b*, that extend from and are coaxial with the feed roller 300. These rods 302*a*, 302*b* are received in tubes 303*a*, 303*b*. The tubes 303*a*, 303*b* are held in slots 304*a*, 304*b* in outer plates 306*a*, 306*b* under loading by springs 308*a*, 308*b*.

The outer plates 306*a*, 306*b* slideably attach to the respective main portions 281 of the brackets 280*a*, 280*b*, with the connections between the plates 306*a*, 306*b* and the main portions 281*a*, 281*b* maintained by clamping screws 310. The screws 310 extend through openings (not shown) in the outer plates 306*a*, 306*b*, and the screws 310 extend into slots 312 in the brackets 280*a*, 280*b*. This movement allows for manual positioning of the outer plates 306*a*, 306*b*, and accordingly, adjustability of the elevation of the feed roller 300.

Rod 302*a* extends beyond the tube 303*a*, and attaches to a pulley 314. The attachment is such that the rod 302*a*, and accordingly, the feed roller 300, is moved (rotated) by rotation of the pulley 314. The pulley 314 receives a drive belt 316, that connects to an inner track 317 of a pulley 450 associated with a second feed roller 421. An idler 318 contacts the drive belt 316, to tension this belt 316. The idler 318 is mounted on an arm 320 that pivotally attaches to the outer plate 306*a*, by virtue of a screw 321 or the like. The idler 318 is spring biased, pulled downward by a spring 322 attached to the arm 320 and the extended portion 282*b*, to continuously tension the belt 316.

The second bed portion 223 includes a planer 404 and, for example, a saw blade 405, mounted on a cylinder 406, to rotate them. The planer 404 includes a bit 408 or the like, to create the desired effect, imprint, or the like, on the surface or side of the work piece. The planer 404 is designed to rotate in a direction against the direction of the movement of the work piece, for example, counterclockwise (as viewed in the direction into the paper, as per the arrow 409 for the cylinder 406 of FIG. 6).

The roller support frame 240 supports the cylinder 406 and drive feed rollers 420, 421, in rotatable engagements. The frame 240 is open, and typically includes a hood 424 (FIG. 5), with a dust collection tube 426. The dust collection tube 426 is also attached to the vacuum source (not shown). The frame 240 attaches to the support 224. Other dust collection tubes attached to vacuum sources are permitted for the apparatus 220 at numereous locations, including, for example, those locations shown for the apparatus 20.

The cylinder 406 extends through an opening 428*a* in the frame 240, and is received in a rotatable engagement in a column 430, that is attached to the frame 240. The opposite end of the cylinder 406 extends through an opening 428*b* in the frame 240, where it is attached to a head (pulley) 433. The head 433 is rotatable and receives one or more belts 434. The belts 434, in turn, are received by a lower head (pulley) 435, that is coupled to a drive motor 436 (FIG. 7).

The drive feed rollers 420, 421 include rods 420*a*, 420*b*, 421*a*, 421*b* coaxial with the rollers 420, 421 and extending therefrom. The rods 420*a*, 420*b*, 421*a*, 421*b* are received in tubes 438*a*, 438*b*, 439*a*, 439*b*. The tubes 438*a*, 438*b*, 439*a*, 439*b* are received in openings 440*a*, 440*b*, 441*a*, 441*b* in the frame 240, with the tubes 438*a*, 438*b*, 439*a*, 439*b* being loaded by springs 444 and screw mechanisms (not shown) for tensioning the springs 444.

The rod 420*a* extends through the tube 438*a*, and is attached to a pulley 450, with an inner track 317 and an outer track 452. The rod 421*a* extends through the tube 439*a*, and is attached to a pulley 454. The inner track 317 of the pulley 450, as detailed above, receives the drive belt 316. The outer track 452 of the pulley 450 receives a drive belt 456. This drive belt 456 is also received by the pulley 454, and is received by a head pulley 458, that is connected to a shaft (not shown) extending from a motor 460. The motor 460 drives the pulleys 450, 454, 458, and accordingly, rotates the feed rollers 300 (via the drive belt 316), 420, 421 (in the direction, as indicated by the arrows 300*x*, 420*x*, 421*x*, clockwise, the default direction, as viewed in the direction into the paper of FIGS. 6 and 9). The motor 460 is controlled by a variable speed controller 464, by adjusting a knob 465 correlated to roller 300, 420, 421 speeds, to control the speed of the rollers 300, 420, 421, that move in the default direction. There is also a reverse switch 466, that is employed in the event the direction of the rollers 300, 420, 421 need to be reversed.

The bed portion 223 also supports boards 226. Guides 470*a*, 470*b*, for example, steel members affixed to the board by screws 472, are spaced apart in accordance with the width of the work piece. These guides 470*a*, 470*b* are spaced apart so as to provide a track or pathway for the work piece as it moves from the ingress end 223*a* to the egress end 223*b* of the bed portion 223 of the table 231 under the direction of the feed rollers 420, 421 prior to entering the work area 264 of the bed portion 222. These guides 470*a*, 470*b* are spaced apart at the same distance as the guides 257*a*, 257*b* to define a complete path for the work piece through the apparatus 220.

The guides 470*a*, 470*b* are adjustable, as they can be positioned and held in place by the screws 472 in the openings 474, 475. One or both of the repositioned guides 470*a*, 470*b* can form a pathway for a work piece that is being operated on by the saw blade 405.

Figure 9:
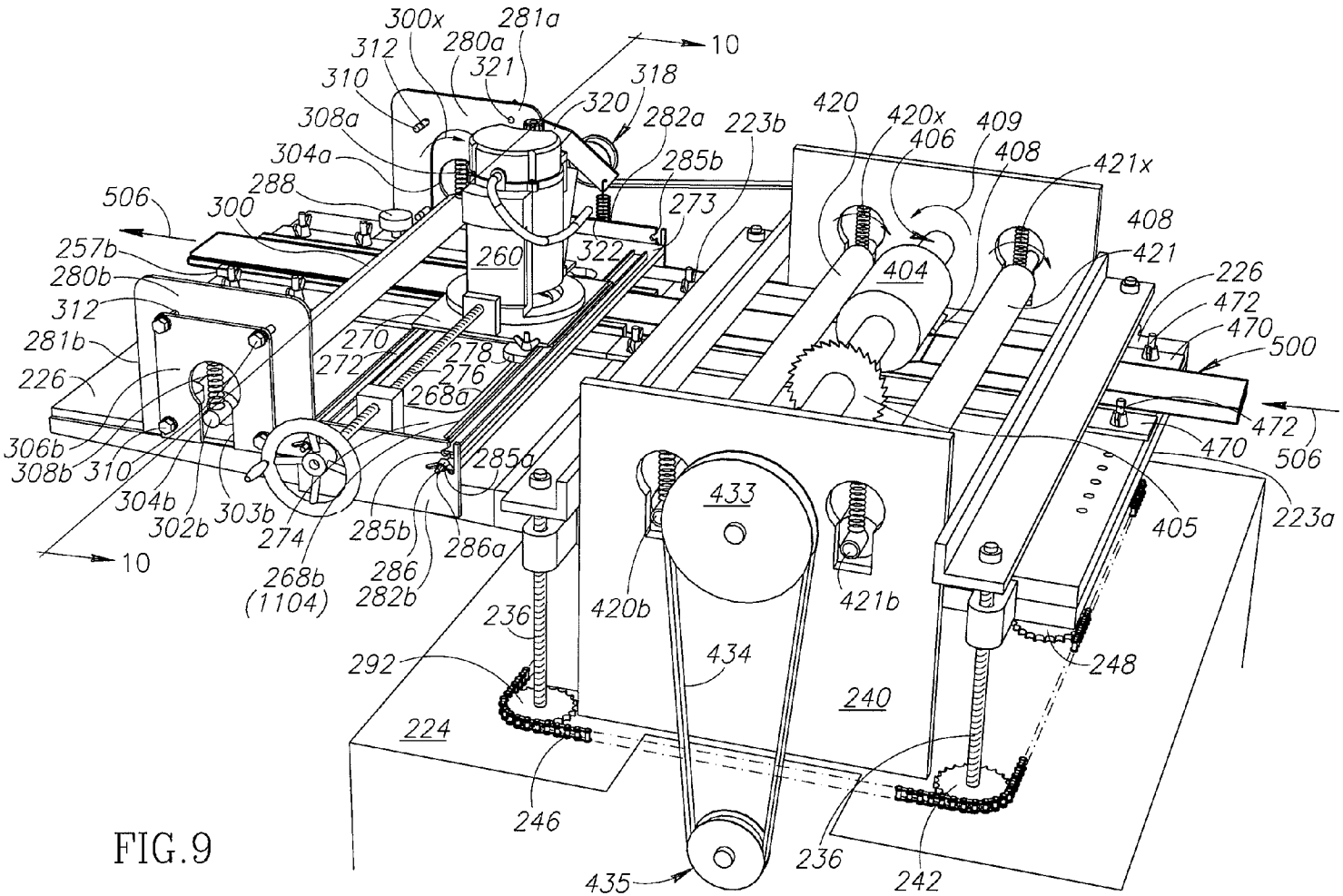
FIG. 9 is the apparatus of FIG. 6 (with some of the components shown in FIG. 6 removed), shown with a work piece being worked therein; and, FIG. 10 is a cross-sectional view of the work piece of FIG. 9 being worked, taken along line 10-10 of FIG. 9.
Figure 10:
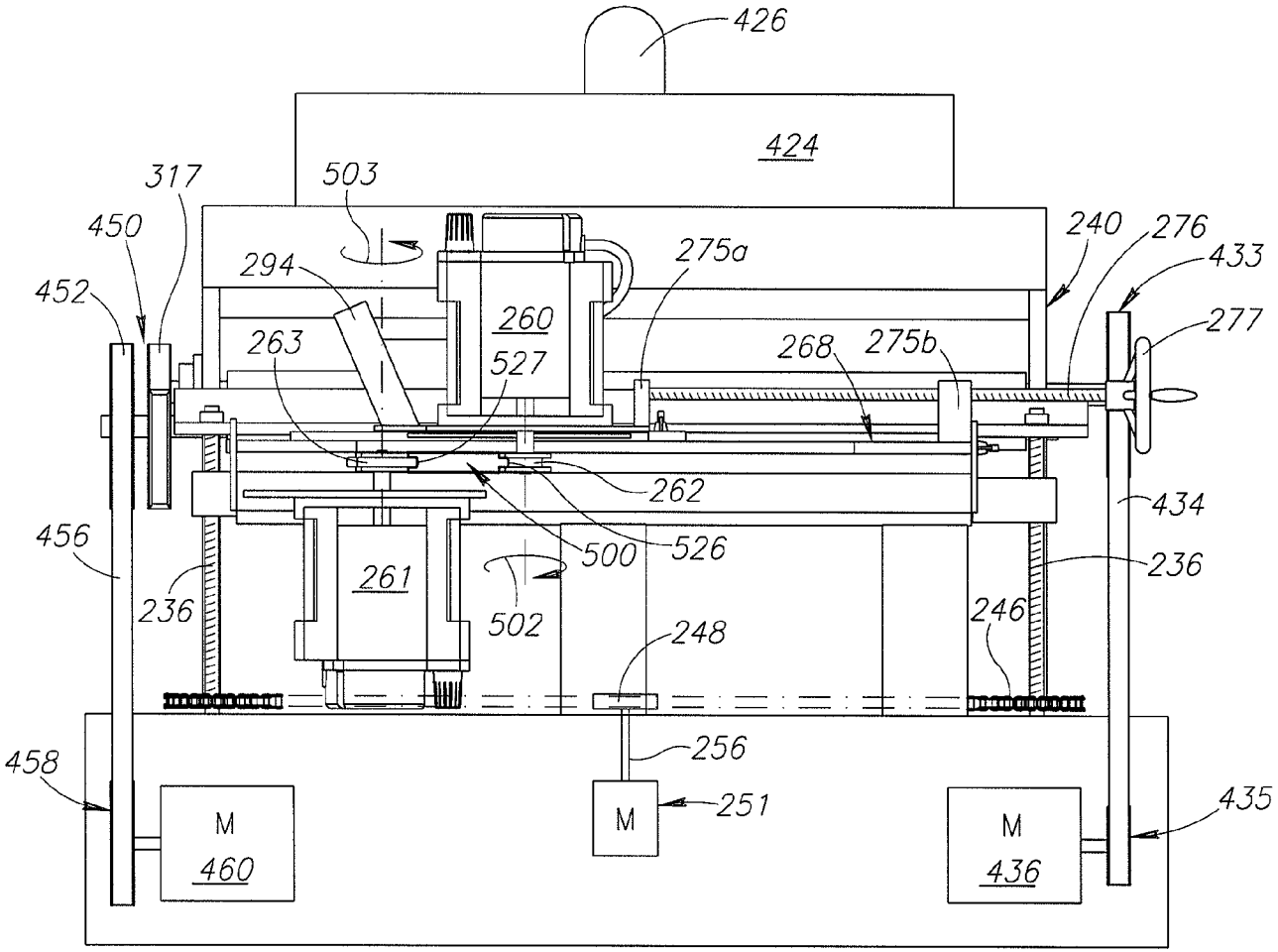

For example, as shown in FIGS. 9 and 10, and also making reference to FIGS. 5-8, a work piece, for example, a wood board 500 has been placed into the apparatus 220, between the guides 470*a*, 470*b*. Previously, the height of the drive feed roller 300 was adjusted for the work piece, as well as the routers 260, 261. The upper router 260 is adjusted laterally by turning the wheel 277 and vertically by securing the shelf 268 at the desired elevation and securing it in the corresponding slots 284*a*, 284*b*, 285*a*, 285*b*. The upper router 260 and the lower router 261 are adjusted vertically by their internal vertical adjustment mechanisms, as they are, for example, "plunge" routers.

The board work piece 500 is placed on the table 231, so as to be moved toward the first table 230 by the drive feed rollers 420, 421 (rotating in the directions of the arrows 420*x*, 421*x*). The drive feed rollers 420, 421 (and when the work piece 500 is in contact with it, drive roller 300) rotate (in the directions of arrows 420*x*, 421*x*, 300*x*) so as to provide a force greater than rotation of the planar 404 (on the cylinder 406 rotating in the direction of the arrow 409) and the blades 262, 263 of the routers 260, 261 (when the routers 260, 261 are in contact with the work piece 500). The router blades 262, 263 rotate in the directions of the respective arrows 502, 503. The work piece 500 is moved in the direction of the arrows 506, along a path defined by the respective, equally spaced-apart guides, 470*a*, 470*b* and 257*a*, 257*b*.

The work piece 500 is continuously pushed by the drive feed rollers 420, 421 along the table 231 in the pathway defined by the guides 470*a*, 470*b*. The upper surface of the work piece 500 may be planed by the planar 404. The work piece remains guided by the guides 257*a*, 257*b* of the table 230, and is now worked by the routers 260, 261. When worked by the routers 260, 261, example, one blade 262 on the first router 260 cuts a tongue 526, on one side of the work piece 500, while the other blade 263 on the second router 261 cuts a correspondingly positioned groove 527 on the other side of the work piece 500.

Once through the routers 260, 261, the work piece 500 contacts the drive feed roller 300, that moves the work piece 500 off of the table 230 (in the direction of the arrows 506). As the process continues, a finished work piece 500 is discharged from the egress end 222*b* of the table 230.

While the workpiece 500 is shown worked on three sides, the planar 404 need not be present, whereby the workpiece is only worked on (on the two, opposite sides) by the routers 260, 261, with the specific blades 262, 263 selected as desired. Alternately, only a single router 260, 261 and blade 262, 263, respectively need be operative, such that only a single side the work piece is worked. This is also applicable for the apparatus 20, detailed above.

While preferred embodiments of the disclosed subject matter have been described, so as to enable one of skill in the art to practice the disclosed subject matter, the preceding description is intended to be exemplary only. It should not be used to limit the scope of the disclosure, which should be determined by reference to the following claims.

What is claimed is:

1. A material working apparatus comprising:

a first table including a substantially planar bed for supporting a workpiece, the bed including an open area therein, the open area defining a work area;

a first holder operatively securing a first router with cutting blades, the first holder mounted to the underside of the table;

a second holder operatively securing a second router with cutting blades, the second holder mounted to the topside of the table and disposed directly across the substantially planar bed from the first holder such that the cutting blades of the routers are positionable within the work area for abrading the workpiece, at least one of the first or second holder capable of linear displacement from the other holder in order to accommodate workpieces of varying widths;

a first table height adjustment mechanism; and a second table operatively coupled to and aligned with the first table work area, the second table including a planer for abrading the workpiece wherein the workpiece is moved from the second table to the first table by at least one feed roller with a first and second end, the first and second ends of the feed roller secured to the second table.

2. The material working apparatus of claim 1, additionally comprising at least one retaining member secured to the table in alignment with the pathway for the work piece for preventing upward movement of the work piece.

3. The material working apparatus of claim 2, wherein the at least one retaining member includes two retaining members disposed on opposite sides of the work area.

4. The material working apparatus of claim 1, wherein the first router and the second router include operatively mounted cutting blades, the cutting blades configured to be rotatable in a direction that opposes the linear direction of travel of a work piece being worked.

5. The material working apparatus of claim 1, wherein the planer is configured to be rotatable in a direction opposite the linear direction of travel of a work piece being planed.

6. A material working apparatus comprising:

a first table including a substantially planar bed for supporting a workpiece, the bed including an open area therein, the open area defining a work area;

a first holder operatively securing a first router, the first holder mounted to the underside of the table;

a second holder operatively securing a second router, the second holder mounted to the topside of the table and disposed across the substantially planar bed from the first holder such that cutting blades of the routers are positionable within the work area for abrading the workpiece, the first and second holder being linearly displaceable from one another to accommodate workpieces of varying widths;

a first table height adjustment mechanism; and a second table operatively secured to and aligned with the first table work area, the second table including a planer for abrading the workpiece wherein the workpiece is moved from the second table to the first table by at least one feed roller operatively coupled to a power source.

7. The material working apparatus of claim 6, wherein the first table height adjustment mechanism comprises a plurality of receivers with threaded openings secured to the planar bed, the receivers receiving a first end of a substantially vertically oriented threaded rod with a sprocket secured to the second end of each threaded rod, a chain extending around the sprockets and a drive motor providing bi-directional movement to the chain facilitating vertical repositioning of the planar bed to accommodate workpieces of varying dimensions.

* * * * *